US008702451B2

(12) United States Patent
Luo et al.

(10) Patent No.: US 8,702,451 B2
(45) Date of Patent: Apr. 22, 2014

(54) ELECTRICAL CONNECTOR WITH GROUNDING BARS THEREIN TO REDUCE CROSS TALKING

(75) Inventors: Yu Luo, Shenzhen (CN); Xing-Liang Liu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 34 days.

(21) Appl. No.: 13/459,084

(22) Filed: Apr. 28, 2012

(65) Prior Publication Data

US 2012/0282808 A1 Nov. 8, 2012

(30) Foreign Application Priority Data

May 3, 2011 (CN) ..... 2011 2 0136325 U

(51) Int. Cl.
*H01R 13/648* (2006.01)

(52) U.S. Cl.
USPC ..... 439/607.28; 439/629; 439/637

(58) Field of Classification Search
USPC ..... 439/607.28, 629, 637, 660, 79
See application file for complete search history.

(56) References Cited

U.S. PATENT DOCUMENTS

| | | | | |
|---|---|---|---|---|
| 6,942,524 | B2 | 9/2005 | Wu | |
| 8,342,886 | B2 * | 1/2013 | Zhang et al. | 439/660 |
| 8,353,726 | B2 * | 1/2013 | Zhang et al. | 439/629 |
| 2009/0221165 | A1 | 9/2009 | Buck et al. | |
| 2011/0269346 | A1 | 11/2011 | Casher et al. | |
| 2012/0108109 | A1 * | 5/2012 | Zhang et al. | 439/629 |
| 2012/0238145 | A1 * | 9/2012 | Zhang et al. | 439/660 |
| 2013/0149882 | A1 * | 6/2013 | Luo et al. | 439/108 |

* cited by examiner

*Primary Examiner* — Hae Moon Hyeon
(74) *Attorney, Agent, or Firm* — Wei Te Chung; Ming Chieh Chang

(57) ABSTRACT sa An electrical connector includes an insulating housing defining an uninterrupted tongue portion with opposite first surface and second surface and a plurality of contacts loaded in the tongue portion. The contacts includes a first group of contacts with first contacting portions loaded in the first surface, a second group of contacts with second contacting portions loaded in the second surface. Each of the first and second group of contacts is composed of signal contacts and grounding contacts and a connecting bar is assembled to electrically connect at least one first grounding contact and one second grounding contact.

20 Claims, 8 Drawing Sheets

ELECTRICAL CONNECTOR WITH GROUNDING BARS THEREIN TO REDUCE CROSS TALKING

BACKGROUND OF THE INVENTION

1. Field of the Invention

The present invention generally relates to an electrical connector, and more particularly to an electrical connector capable of high speed and backwards compatibility with relative lower high speed.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. Particularly, crosstalk is a major issue at 12 Gbps. So, we hope design an electrical connector to overcome said question.

SUMMARY OF THE INVENTION

Accordingly, an object of the present invention is to provide electrical connectors capable to high speed.

In order to achieve the object set forth, an electrical connector includes an insulating housing defining an uninterrupted tongue portion with opposite first surface and second surface and a plurality of contacts loaded in the tongue portion. The contacts includes a first group of contacts with first contacting portions loaded in the first surface, a second group of contacts with second contacting portions loaded in the second surface. Each of the first and second group of contacts is composed of signal contacts and grounding contacts and a connecting bar is assembled to electrically connect at least one first grounding contact and one second grounding contact.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Referring to FIGS. 1-5, an electrical connector 100 mounted on a PCB 300 is used for providing interfaces for a high speed storage device, especially for SAS signal transmission which is capable to 12 Gbps operation.

Figure 1:
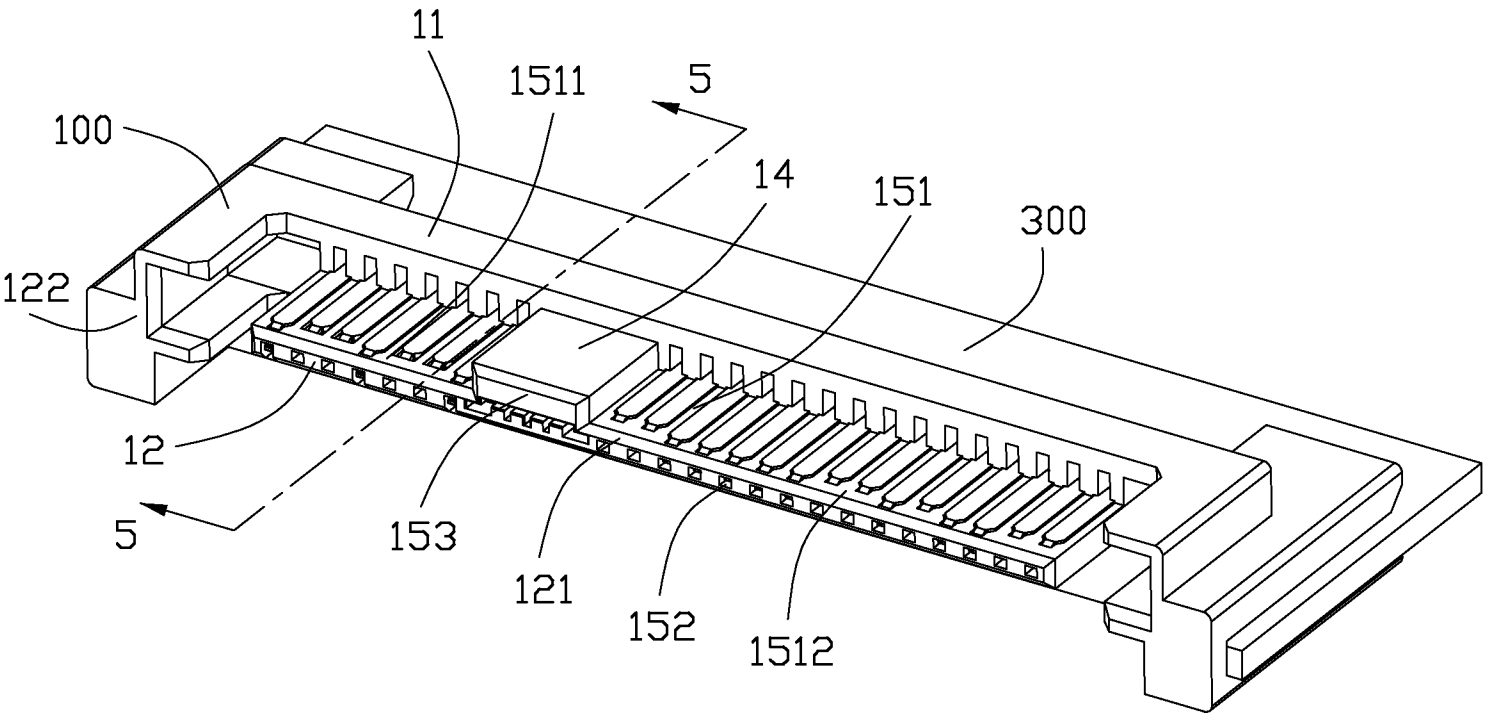
FIG. 1 is a perspective view of an electrical connector of a first embodiment in accordance with the present invention.
Figure 2:
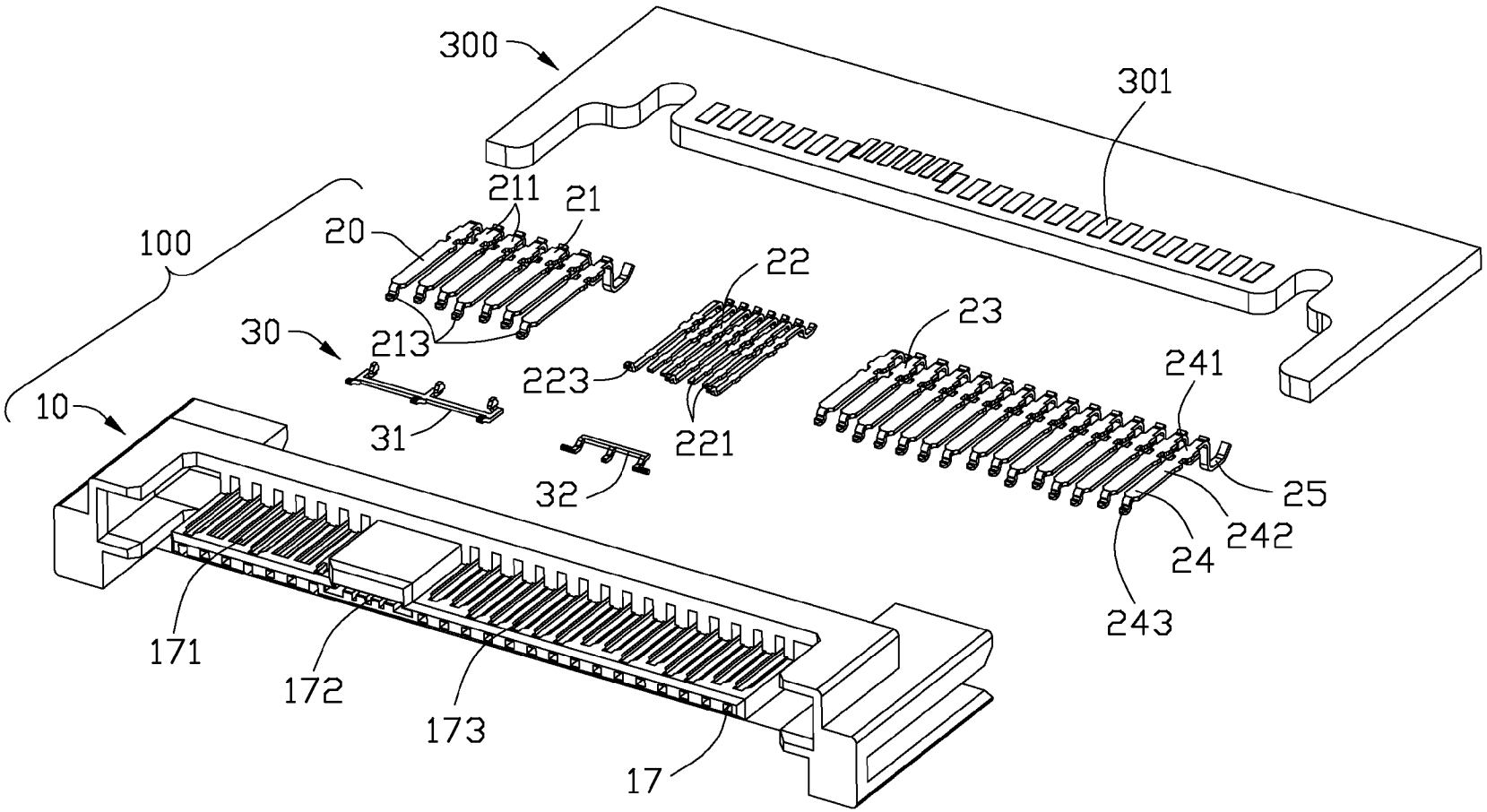
FIG. 2 is an exploded perspective view of the electrical connector shown in FIG. 1.

Referring to FIGS. 1 and 2, the electrical connector 100 includes an insulative housing 10, a plurality of contacts 20 (including first contacts 21, second contacts 22 and third contacts 23) received in the insulative housing 10 and grounding bars 30 (including a first grounding bar 31 and a second grounding bar 32). The insulative housing 10 defines a lengthwise direction and a transverse direction perpendicular to each other and comprises a rear wall 11 and an elongated mating portion 12 which is formed by an uninterrupted tongue portion 121 and a pair of guiding portions 122 of an inverted U shape commonly extending from the rear wall 11. The tongue portion 121 extends along the lengthwise direction and defines opposite first and second surfaces 151, 152 arranged in said transverse direction and a rib 14 is formed at the first surface 151 unitarily extending forwards from the rear wall 11 to a front surface 153. The rib 14 divides the first surface 151 into a first sub surface 1511 and a second sub surface 1512 and the second sub surface 1512 is larger than the first sub surface 1511 along the lengthwise direction. The contacts 21, 22, 23 are respectively loaded in first passageways 171 located on the first sub surface 1511, a second passageways 172 located on the second surface 152 and third passageways 173 located on the second sub surface 1512.

The first sub surface 1511 is loaded with a group of seven first contacts 21 in corresponding passageways 171 not through the front face, which is functioned as a signal segment S1-S7 defined in SAS 2.0 Specification. The second surface 152 is loaded with a group of seven second contacts 22 in the passageways 172 through the front face of the tongue portion 121, which is functioned as a signal segment S8-S14 defined in SAS 2.0 Specification. The second sub surface 1512 is loaded with a group of fifteen third contacts 23 in the passageways 173 through the front face of the tongue portion, which is functioned as a power segment P1-P15 defined in SAS 2.0 Specification. Please note, both of the first and second contacts 21, 22 are arranged in a pattern with G-S(+)-S(−)-G-S(+)-S(−)-G, So three contacts of each group of contacts are of grounding contacts, which are labeled with numerals 213, 223. The signal contacts are labeled with numerals 211, 221.

The contacts 20 in every segment have same configure, so we take the first contacts 21 for instance. Each first contact 21 is of a plate type by cutting a metal sheet and includes a retaining portion 24 with barbs 241 at a side edge thereof, a plate mating portion 242 at a front free end thereof and a tail portion 25 at a rear free end to contact with a printed circuit spot 301 of the PCB 300. The plate mating portion 242 and the tail portion 25 extend from opposite lateral sides of the retaining portion 24. The plate mating portion 242 of each first contact 21 is parallel and level to the first surface 151. An opening_17 is depressed from the front surface 153 and communicating with the passageways 171, and the free end of each plate mating portion 242 forms a hook portion 243 receiving in the opening_17.

Figure 3:
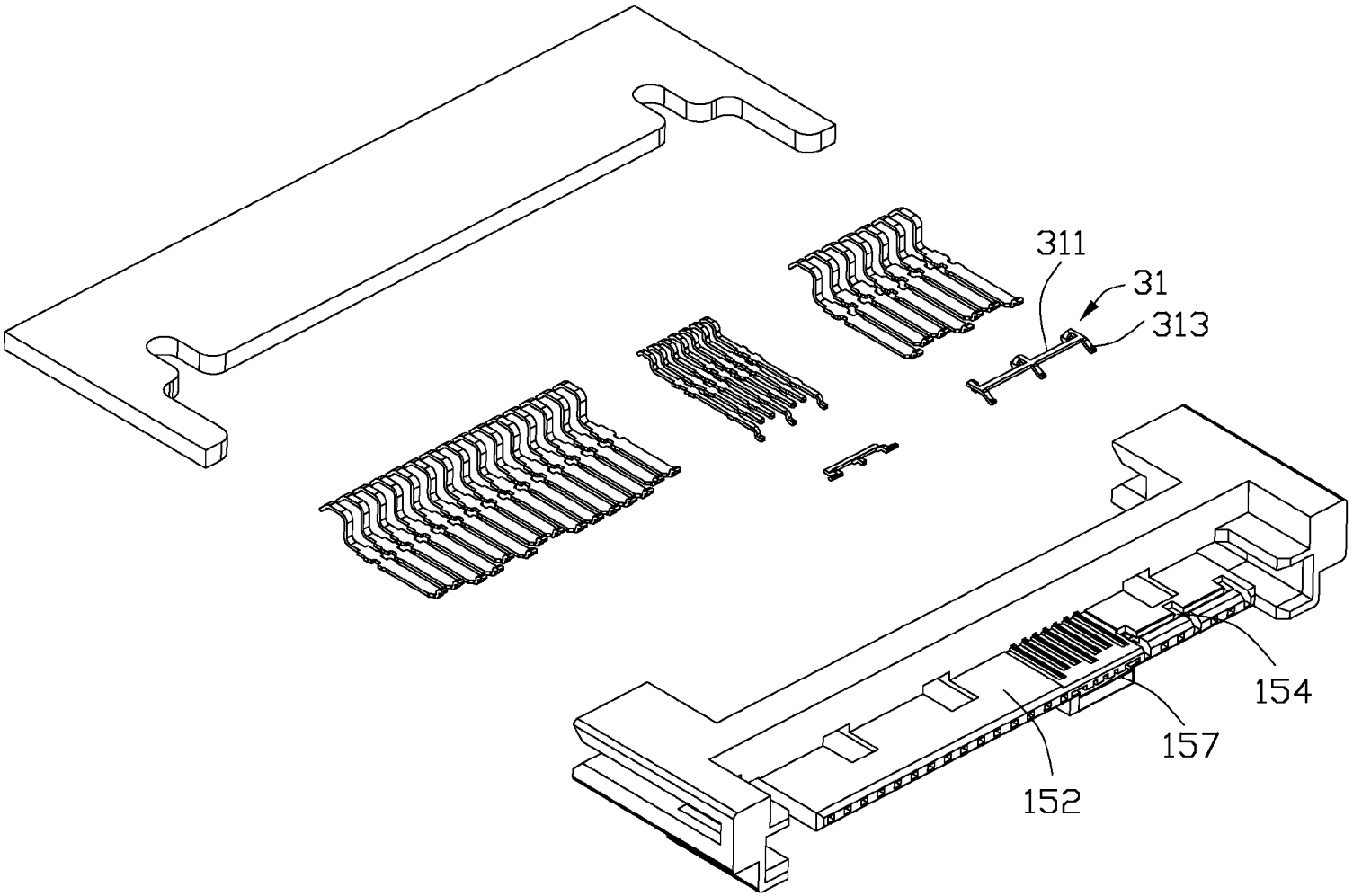
FIG. 3 is another exploded perspective view of the electrical connector shown in FIG. 1.
Figure 4:
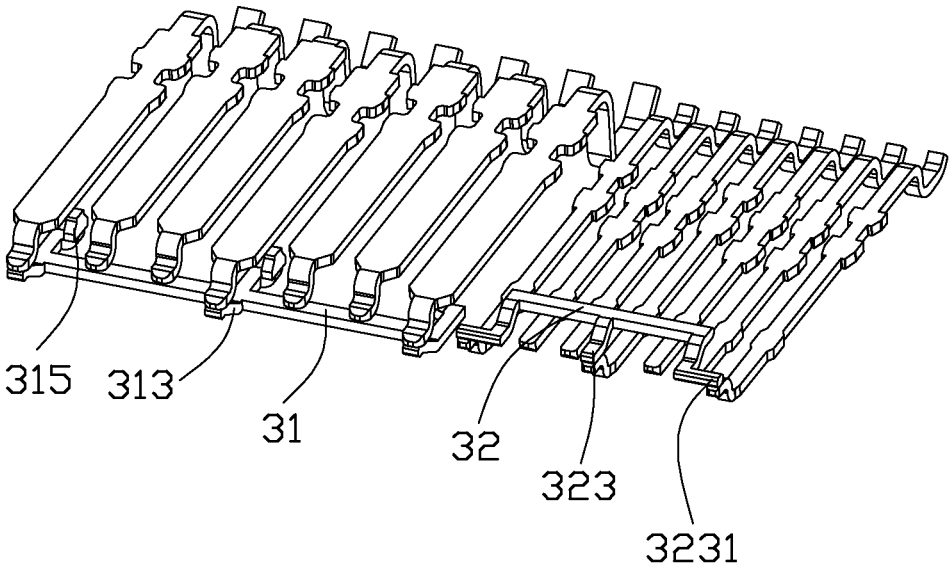
FIG. 4 is a perspective view of contacts of the electrical connector shown in FIG. 1.
Figure 5:
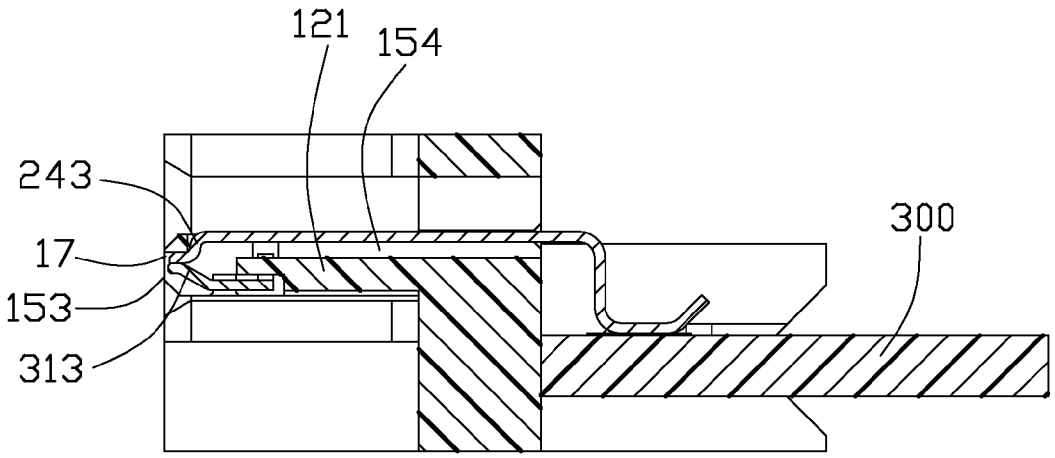
FIG. 5 is a cross section view of the electrical connector taken along a broken line 5-5 in FIG. 1.

Referring to FIGS. 3 to 5, the second surface 152 opposite to the first sub surface 1511 forms a first cavity 154 communicating with the first passageways 171 for receiving the first grounding bar 31. The first grounding bar 31 comprises an elongated base 311 of bridge form, three elastic fingers 313 (i.e., first elastic fingers) extending forwards and toward the first contacts 21 and a retaining barbs 315 bending rearward and engaging with the first cavity 154 along the transverse direction. After assembled into the first passageways 171, the three elastic fingers 313 touches and electrically connects the hook portion 243 of grounding contacts 213 of the first contacts 21 to connect said three grounding contacts 213 together. The front surface 153 of the rib 14 forms a second cavity 157 communicating with the second passageways 172 for receiving the second grounding bar 32 and also forms three elastic fingers 323 (i.e., second elastic fingers) to connect corresponding grounding contacts 223 of the second contact 22. The outermost two elastic fingers of the second grounding bar 32 further define two touching portions 3231 extending outwards along the lengthwise direction. The grounding bars 31, 32 connecting the grounding contacts 213,_223 will reduce the crosstalk. Therefore, the electrical connector 100 can be used to transport high speed up to 12Gbps. Moreover, the electrical connector is same to the designation of the connectors in SAS 2.0 Specification in dimension and pin arrangement which has a high speed capable to 6Gbps except the addition of the grounding bars. Using a same interface, the connectors of this present invention speed signal transmission up to 12Gbps.

Figure 6:
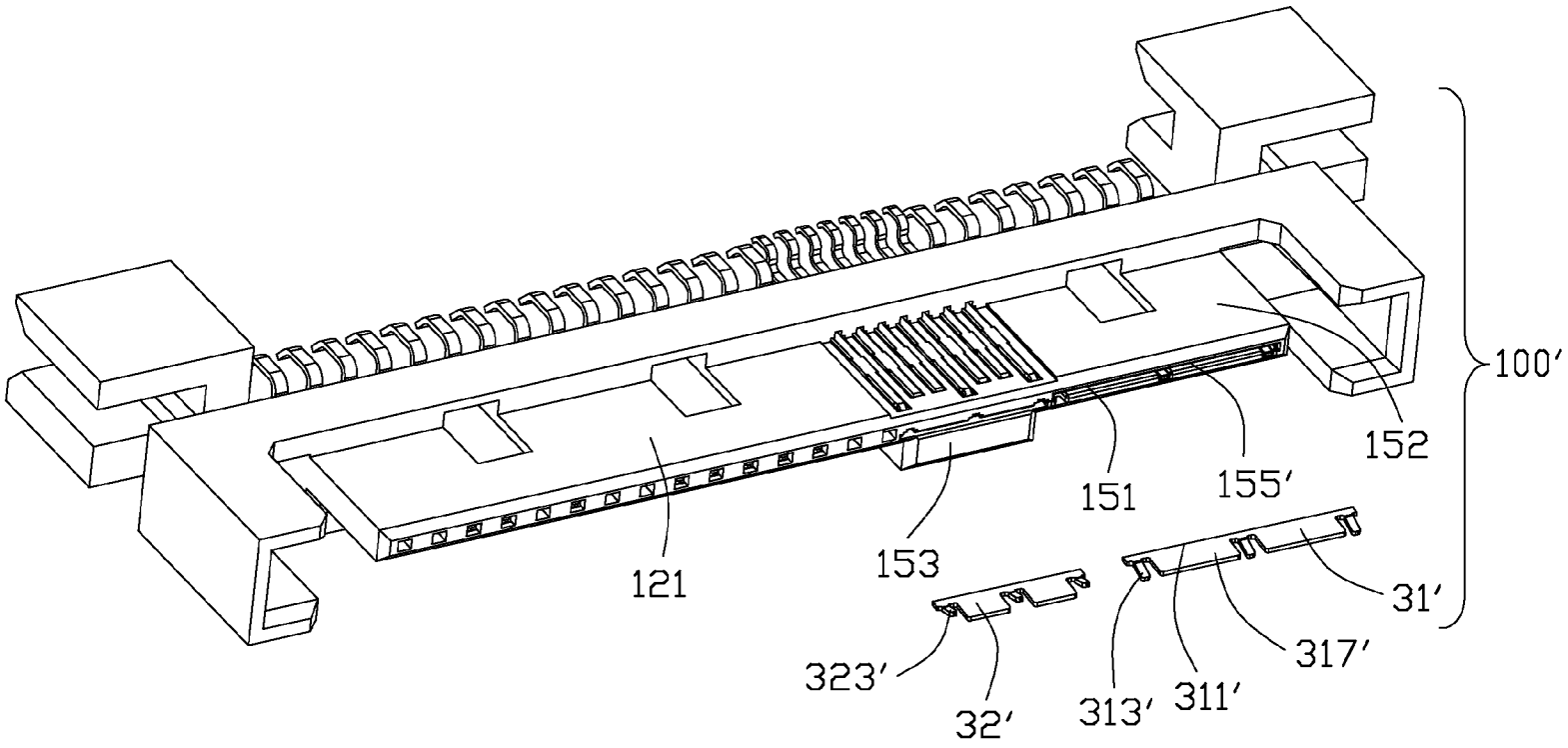
FIG. 6 is an exploded view of an electrical connector of a second embodiment in accordance with the present invention, with the connecting bar separated from the insulative housing.
Figure 7:
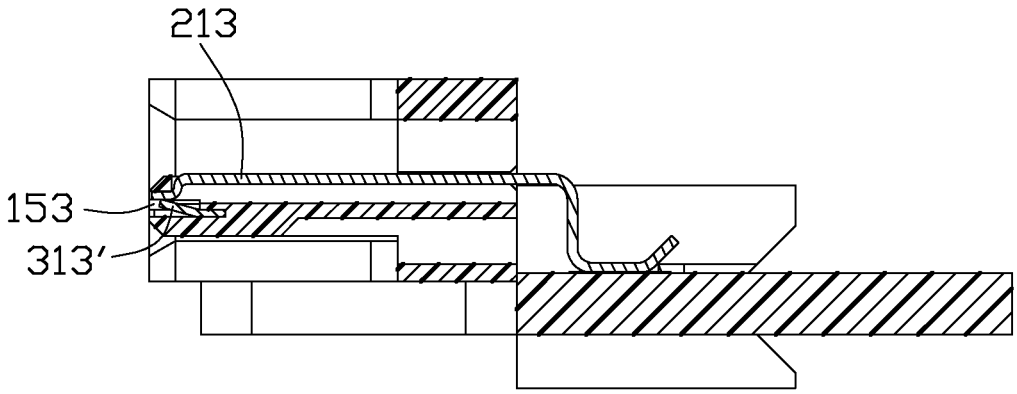
FIG. 7 is a cross sectional view similar to FIG. 5 to show the connector of the second embodiment of the present invention.

FIGS. 6 and 7 show a second embodiment of the invention, which give an illustration of an electrical connector 100' wherein description of same and similar element are omitted. The first grounding bar 31' is of a plate type and each comprises an elongated base 311', three first elastic fingers 313' extending toward the first surface 151 and two shielding sheets 317' located between the first surface 151 and the second surface 152. The front surface 153 forms a first cavity 155' communicating with the first passageways for receiving the first grounding bar 31'. The second grounding bar 32' has the similar structure with the first grounding bar 31', the difference is the second elastic fingers 323' of the second grounding bar 32' extends toward the second surface 152 opposite to the first one. It is noted that the first grounding bar 31' defines a plurality of notches (not labeled) in which the first elastic fingers 313' are located, and similarly the second grounding bar 32' defines a plurality of notches (not labeled) in which the second elastic fingers 323' are located.

Figure 8:
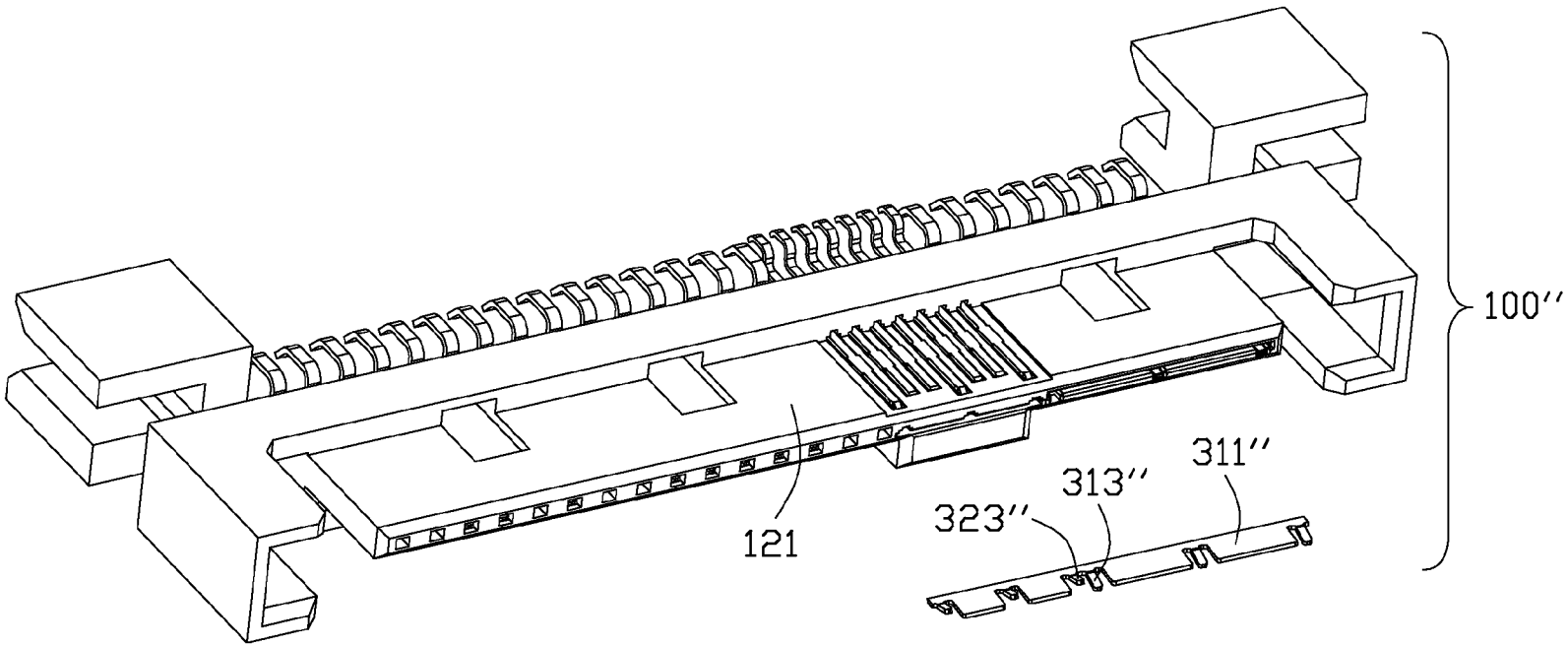
FIG. 8 is an exploded view of an electrical connector of the third embodiment in accordance with the present invention, with the connecting bar separated from the insulative housing.

FIG. 8 shows electrical connector 100" of a third embodiment of the invention. The electrical connector 100" forms an uncorrupted cavity extending along the lengthwise direction corresponding to the first contact and the second contact. A unitarily grounding bar 311" is assembled into the cavity with first elastic fingers 313" and second elastic fingers 323" connecting the first and second grounding contacts in different surfaces.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulating housing defining an uninterrupted tongue portion extending along a lengthwise direction and a transverse direction with opposite first surface and second surface; and a plurality of contacts loaded in the tongue portion, and comprising a first group of contacts with first contacting portions loaded in the first surface; wherein the first group of contacts is composed of two pairs of differential pair signal contact and three grounding contacts, and a first grounding bar defines an elongate base extending in the lengthwise direction and three elastic fingers extending in the transverse direction and mechanically and electrically connect the grounding contacts of the first group of contacts in a third direction perpendicular to the lengthwise direction and the transverse direction.

2. The electrical connector as claimed in claim 1, wherein the first grounding bar is assembled into the insulating housing from a front face of the tongue portion, the first grounding bar defines retaining barbs extending oppositely to the elastic fingers in the transverse direction and retained with the tongue portion in the third direction.

3. The electrical connector as claimed in claim 1, wherein the first grounding bar is located between the first surface and the second surface.

4. The electrical connector as claimed in claim 1, wherein the plurality of contacts comprises a second group of contacts with second contacting portions loaded in the second surface, a second grounding bar is located between the first surface and the second surface and mechanically and electrically connect grounding contacts of the second group of contacts in the third direction.

5. The electrical connector as claimed in claim 4, wherein the second grounding bar comprises an elongated base extending in the lengthwise direction and three elastic fingers extending in the transverse direction, two outmost elastic fingers define touching portions respectively extending outwards in the lengthwise direction and mechanically and electrically connecting corresponding grounding contacts of the second group of contacts and a middle elastic finger of said three elastic fingers directly mechanically connects corresponding ground contact of the second group of contacts.

6. The electrical connector as claimed in claim 1, wherein an opening is depressed from the front surface for receiving a hook portion formed on a free end of each grounding contact and the first grounding bar is electrically attached on the hook portion.

7. The electrical connector as claimed in claim 1, wherein the first grounding bar defines a shielding sheet extending along the elongate base and located between every two elastic fingers.

8. An electrical connector comprising:

an insulating housing defining a first mating surface; and a plurality of contacts loaded on the first mating surface, the contacts comprising two grounding contacts and a differential pair contacts located between the two grounding contacts; wherein a grounding bar is defined to electrically connect the two grounding contacts; the grounding bar comprises an elongated base, two elastic fingers extending from a first side of the elongated base for contacting with the first grounding contacts and a shielding sheet extending from the same side of the elongated base and located between the two elastic fingers.

9. The electrical connector as claimed in claim 8, wherein the elastic arms extend forwards in a front-rear direction and bending in a vertical direction perpendicular to the lengthwise direction and the front-rear direction.

10. The electrical connector as claimed in claim 8, wherein the shielding sheet is of a flat type, and the elastic fingers are respectively split out from both side of the shielding sheet.

11. The electrical connector as claimed in claim 10, wherein the insulating housing defines a contact arranging direction paralleling to the first mating surface, the shielding sheet and the elastic fingers are alternately arranged in the contact arranging direction.

12. An electrical connector comprising:

an insulative housing defining a tongue portion extending along a longitudinal direction, said tongue portion defining opposite first and second surfaces;

a plurality of first contacts disposed in the housing with first contacting sections exposed upon the first surface;

a plurality of second contacts disposed in the housing with second contacting sections exposed upon the second surface;

a first grounding bar and a second grounding bar essentially located between the first surface and the second surface in a front view; wherein the first grounding bar extends in the longitudinal direction with some first elastic fingers extending toward and abutting against the corresponding first contacting sections, respectively, and the second grounding bar extends in the longitudinal direction with some second elastic fingers extending toward and abutting against the corresponding second contact sections, respectively.

13. The electrical connector as claimed in claim 12, wherein the first grounding bar and the second grounding bar are located at a front edge region of the tongue portion.

14. The electrical connector as claimed in claim 12, wherein each of the first grounding bar and the second grounding bar defines a plurality of notches in which the corresponding first and second elastic fingers are located.

15. The electrical connector as claimed in claim 12, wherein a rib is formed on the first surface opposite to an area of the second surface occupied by the second contacting sections in a vertical direction perpendicular to said longitudinal direction, and said rib is configured to allow the second connecting bar to be assembled thereinto in a front-to-back direction perpendicular to both said longitudinal direction and said vertical direction.

16. The electrical connector as claimed in claim 12, wherein the second surface is configured to allow the second grounding bar to be assembled thereinto in a vertical direction perpendicular to said longitudinal direction.

17. The electrical connector as claimed in claim 12, wherein one of said first elastic fingers and one of the second elastic fingers are intimately neighboring with each other.

18. The electrical connector as claimed in claim 12, wherein the first grounding bar and the second grounding bar are unitarily joined with each other as one piece in the longitudinal direction.

19. The electrical connector as claimed in claim 18, wherein the front edge of the tongue portion defines passage to allow the longitudinal joined first grounding bar and second grounding bar to be inserted thereinto in a front-to-back direction perpendicular to said longitudinal direction.

20. The electrical connector as claimed in claim 12, wherein the elastic fingers cooperate with the tongue portion to sandwich tips of the corresponding contacting sections, respectively, in a vertical direction perpendicular to said longitudinal direction.

* * * * *